US009475064B2

(12) United States Patent
Yang et al.

(10) Patent No.: US 9,475,064 B2
(45) Date of Patent: Oct. 25, 2016

(54) WASTE COLLECTION DEVICE

(71) Applicants: FU DING ELECTRONICAL TECHNOLOGY (JIASHAN) CO., LTD., Zhejiang (CN); HON HAI PRECISION INDUSTRY CO., LTD., New Taipei (TW)

(72) Inventors: Ming-Lu Yang, New Taipei (TW); Ya-Dong Zhang, Jiashan (CN); Lin-Hai Shi, Jiashan (CN)

(73) Assignees: FU DING ELECTRONICAL TECHNOLOGY (JIASHAN) CO., LTD., Zhejiang (CN); HON HAI PRECISION INDUSTRY CO., LTD., New Taipei (TW)

( * ) Notice: Subject to any disclaimer, the term of this patent is extended or adjusted under 35 U.S.C. 154(b) by 194 days.

(21) Appl. No.: 14/517,075

(22) Filed: Oct. 17, 2014

(65) Prior Publication Data

US 2015/0107452 A1 Apr. 23, 2015

(30) Foreign Application Priority Data

Oct. 23, 2013 (CN) ..... 2013 2 0653408

(51) Int. Cl.
*B03C 1/28* (2006.01)
*B03C 1/035* (2006.01)

(52) U.S. Cl.
CPC ..... *B03C 1/286* (2013.01); *B03C 1/035* (2013.01); *B03C 2201/20* (2013.01); *B03C 2201/28* (2013.01)

(58) Field of Classification Search
CPC ... B03C 1/286; B03C 1/035; B03C 2201/28; B03C 2201/20
See application file for complete search history.

(56) References Cited

U.S. PATENT DOCUMENTS 8,132,674 B1 * 3/2012 Allore ..... B03C 1/0332 209/223.1
8,474,629 B1 * 7/2013 Allore ..... B03C 1/284 209/223.1
2009/0084265 A1 * 4/2009 Tiefenauer ..... B01D 46/10 96/55
2015/0128807 A1 * 5/2015 Peteln ..... B01D 45/10 96/226

OTHER PUBLICATIONS

"Magnetic Separators", Nippon Magnetics, Inc. 2001, Nippon Magnetics, Inc. pp. 6-9 https://web.archive.org/save/_embed/http://www.nmi-jpn.com/pdf/general-catalog.pdf.*

* cited by examiner

*Primary Examiner* — Duane Smith
*Assistant Examiner* — Britanny Precht
(74) *Attorney, Agent, or Firm* — Zhigang Ma

(57) ABSTRACT

A waste collection device configured to remove magnetically-sensitive particles from the air includes a main body, a collection mechanism, an air inlet mechanism, an air exhaust mechanism, and a discharge mechanism. The main body includes a cover, an electric controller, a partition, and a cavity. The partition divides the cavity into a first cavity and a second cavity. The collection mechanism includes a plurality of dust deposition portions received in the first and second cavities. Each dust deposition portion is electrically powered and includes a plurality of dust deposition plates. The air inlet mechanism includes a first wind shield coupled to the first cavity and a second wind shield coupled to the second cavity.

15 Claims, 4 Drawing Sheets

WASTE COLLECTION DEVICE

FIELD

The subject matter herein generally relates to the field of waste disposal.

BACKGROUND

In metallic material processing, magnetically-sensitive dust such as iron powder is generated. The magnetically-sensitive dust pervades in the air. An air current can be used to collect the magnetically-sensitive dust.

BRIEF DESCRIPTION OF THE DRAWINGS

Implementations of the present technology will now be described, by way of example only, with reference to the attached figures.

DETAILED DESCRIPTION

Figure 1:
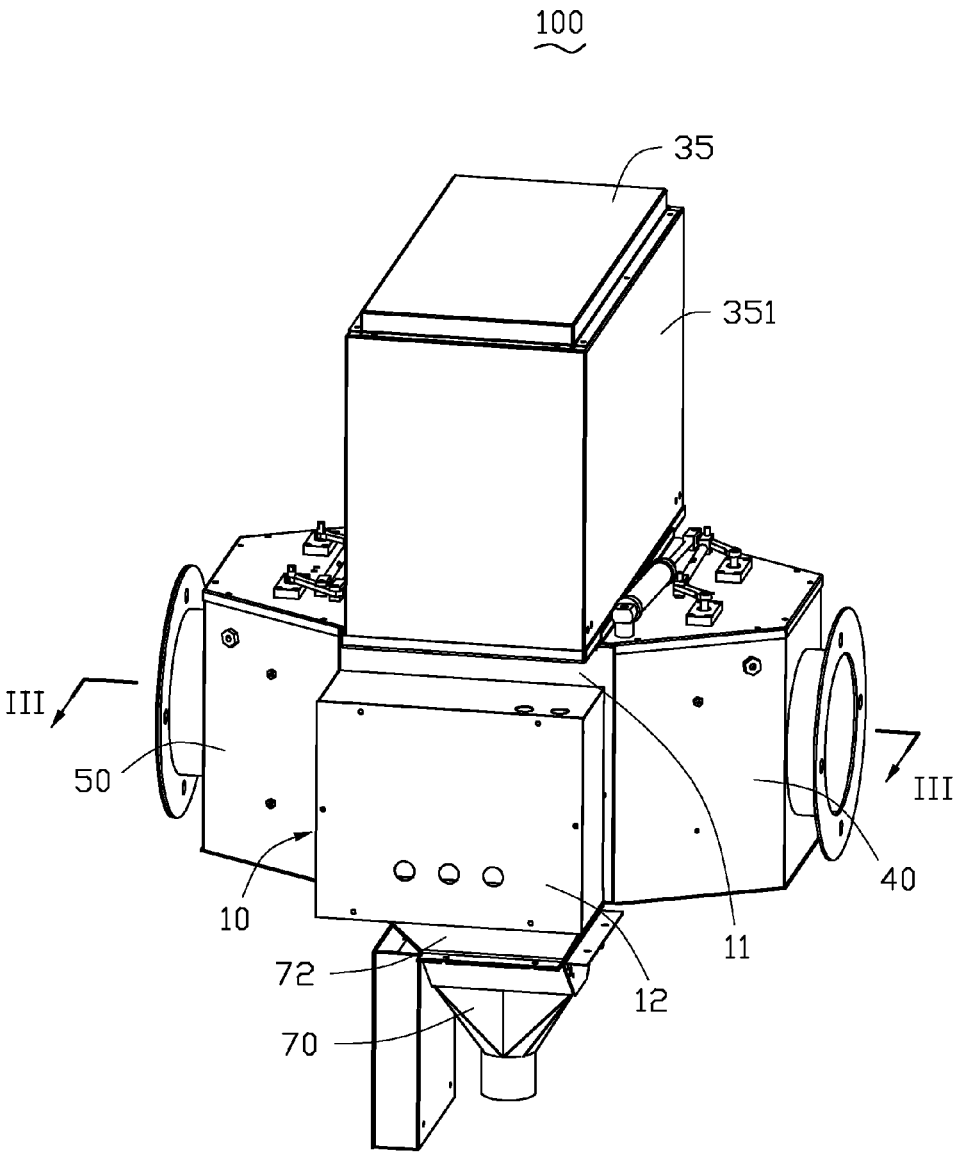
FIG. 1 is an isometric view of an embodiment of a waste collection device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "comprising," when utilized, means "including, but not necessarily limited to"; it specifically indicates open-ended inclusion or membership in the so-described combination, group, series and the like.

FIG. 1 illustrates an embodiment of a waste collection device 100. The waste collection device 100 can be configured to collect and separate magnetically-sensitive dust from the air. The waste collection device 100 can include a main body 10, a replacement mechanism 35, an air inlet mechanism 40, an air exhaust mechanism 50, and a discharge mechanism 70. The air inlet mechanism 40 and the air exhaust mechanism 50 can be mounted to opposite sides of the main body 10. The replacement mechanism 35 can be mounted above the main body 10, and the discharge mechanism 70 can be mounted under the main body 10. The replacement mechanism 35 can include a housing 351. In use, the dust-laden air can enter the main body 10 through the air inlet mechanism 40, and can be vented through the air exhaust mechanism 50 after removal of magnetically-sensitive dust. The magnetically-sensitive dust can be collected in the external collecting container (not shown) through the discharge mechanism 70.

The main body 10 can include a cover 11 and an electric controller 12. A bottom of the cover 11 can be coupled to the discharge mechanism 70 and placed between the air inlet mechanism 40 and the air exhaust mechanism 50. The electric controller 12 can be mounted to one side of the cover 11. The electric controller 12 can include an electronic controller (not shown).

The discharge mechanism 70 can include a connector 72 arranged under the cover 11. The discharge mechanism 70 can be configured to dispose of the magnetically-sensitive dust.

Figure 2:
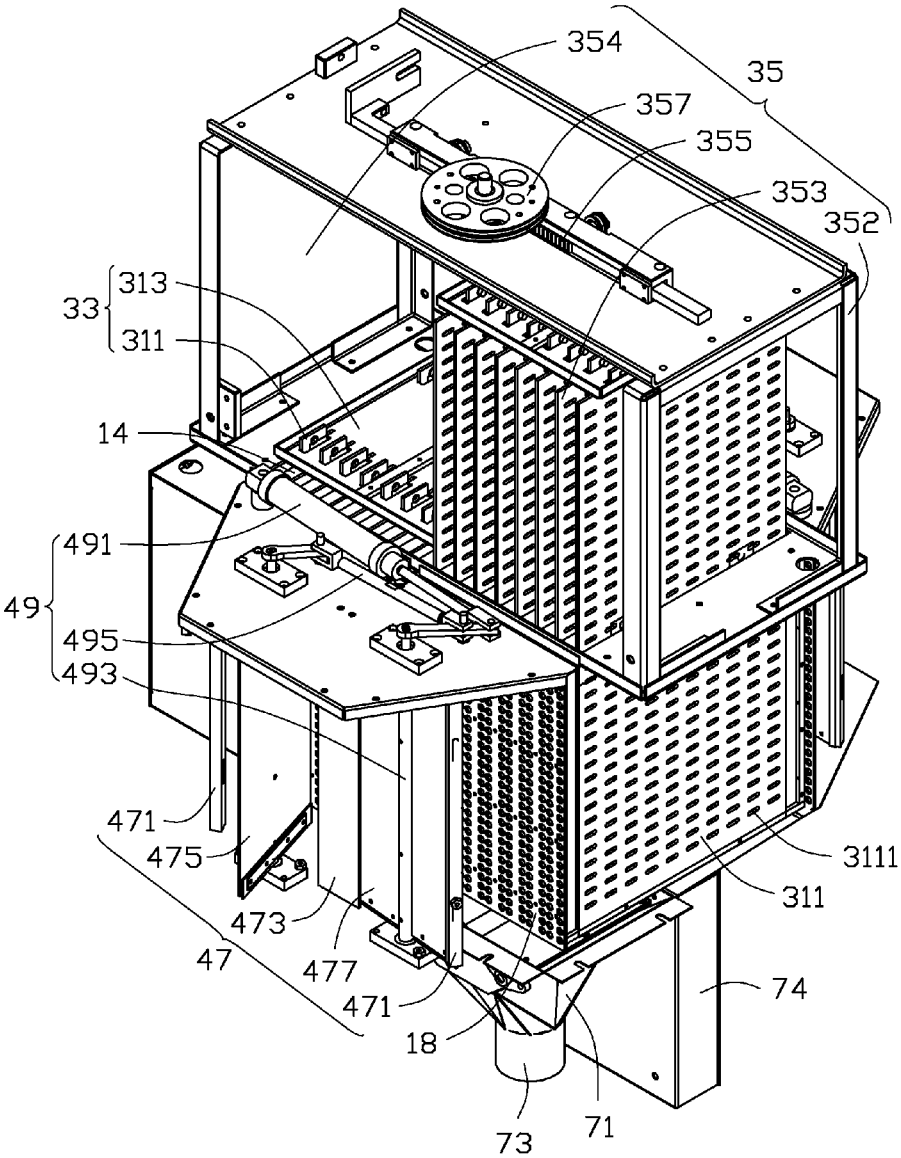
FIG. 2 is a partial, isometric view of the waste collection device of FIG. 1 from another angle.

FIG. 2 illustrates that a collection mechanism 30 can be received in the main body 10. The collection mechanism 30 can include a plurality of dust deposition plates 311 opposite to each other in parallel and a mounting plate 313 vertically arranged to one end of the dust deposition plates 311. An electromagnet (not shown) can be mounted inside the dust deposition plates 311. The dust deposition plates 311 can define a plurality of evenly distributed dust deposition holes 3111. When the collection mechanism 30 is damaged, a replacement mechanism 35 can replace the non-functioning collection mechanism 30 to ensure continuous operation by the waste collection device 100.

The main body 10 can further include a perforated grating plate 14 and two rectifying plates 18. The perforated grating plate 14 can be mounted above the cover 11, and can be configured to be fixed to the mounting plate 313. The two rectifying plates 18 can be arranged in opposite sides of the cover 11, and can ensure a more uniform flow of the air entering the main body 10.

The replacement mechanism 35 can further include a frame 352, a third dust deposition member 353, a plurality of grinding teeth 355, and a gear 357. A replacement cavity 354 can be formed via mounting the housing 351 outside the frame 352. The grinding teeth 355 and the gear 357 can be mounted to a top of the frame 352. The gear 357 can be coupled to the third dust deposition member 353 and can move the third dust deposition member 353. The gear 357 can be engaged with the grinding teeth 355. When the collection mechanism 30 is damaged, the third dust deposition member 353 can act as substitute for the collection mechanism 30. In one embodiment, the replacement mechanism 35 can be omitted.

The air inlet mechanism 40 can include a wind deflector 47 and a first drive member 49. The wind deflector 47 can include two elongated blocks 471, a wind barrier 473, a first wind shield 475, and a second wind shield 477. The first wind shield 475 and the second wind shield 477 can resist against the wind barrier 473 and the blocks 471 when the first wind shield 475 and the second wind shield 477 are closed.

The first drive member 49 can include a first drive component 491, two first rotation shafts 493, and a first linkage 495. In one embodiment, the first drive component 491 can be a telescopic cylinder. The first linkage 495 can be driven by the first drive component 491. The two first rotation shafts 493 can be coupled to the ends of the first linkage 495. The first wind shield 475 and the second wind shield 477 can be fixed to the first rotation shafts 493. The first drive component 491 can move the first linkage 495 to rotate the two first rotation shafts 493. The two first rotation shafts 493 can move the first wind shield 475 to a closed position and the second wind shield 477 to an open position, or can move the first wind shield 475 to an open position and the second wind shield 477 to a closed position.

The discharge mechanism 70 can include a discharge housing 71, a discharge outlet 73, and a box 74. The discharge housing 71 can be coupled to the bottom of the cover 11 by the connector 72. The box 74 can be mounted outside the discharge housing 71. The discharge outlet 73 can be mounted to the bottom of the discharge mechanism 70. The discharge outlet 73 can be configured to collect the magnetically-sensitive dust in the external collecting container.

Figure 3:
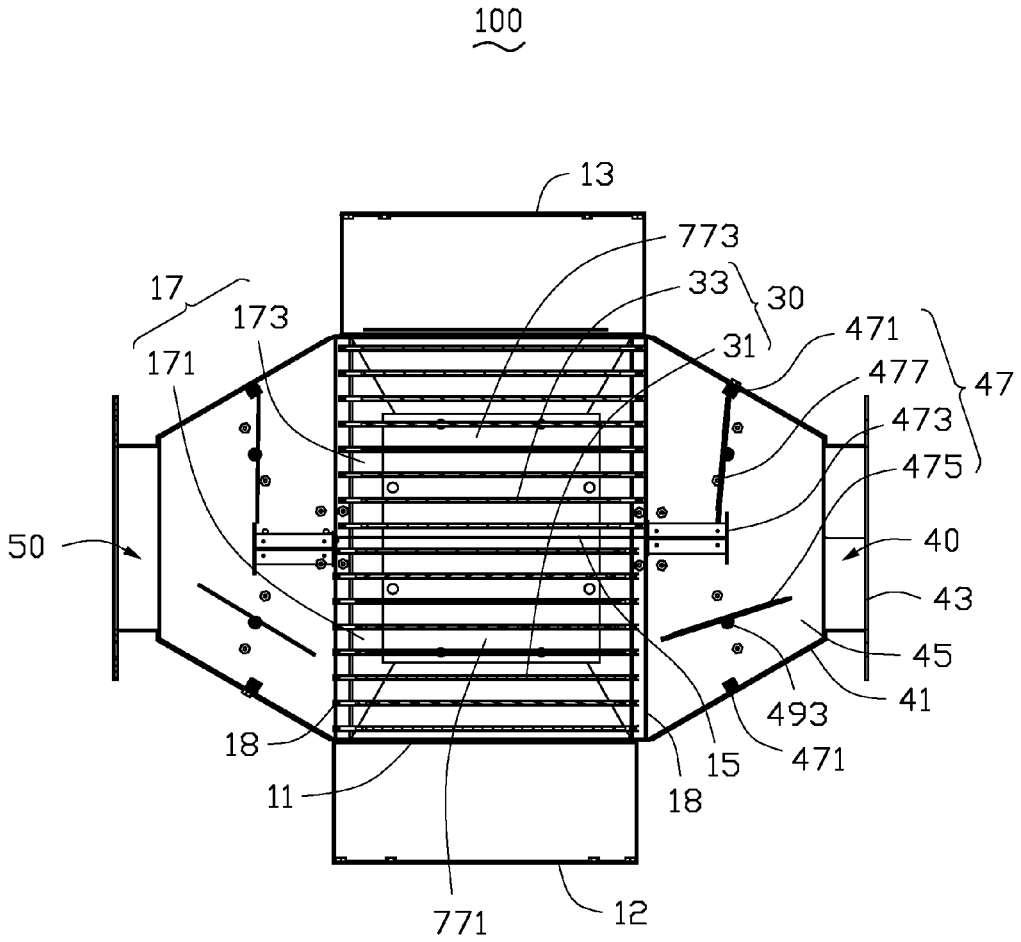
FIG. 3 is a cross-sectional view of the waste collection device of FIG. 1 taken along line III-III.

FIG. 3 illustrates that the main body 10 can further include an air controller box 13 and a partition 15. A cavity 17 can be formed by arranging the two rectifying plates 18 in opposite sides of the cover 11. The partition 15 can be mounted in the cover 11, and can divide the cavity 17 into a first cavity 171 and a second cavity 173. The first cavity 171 can be adjacent to the electric controller 12, and the second cavity 173 can be adjacent to the air controller box 13. The first cavity 171 and the second cavity 173 can communicate with the air inlet mechanism 40 and the air exhaust mechanism 50.

The collection mechanism 30 can be received in the cavity 17. The collection mechanism 30 can include a first dust deposition portion 31 and a second dust deposition portion 33. The first dust deposition portion 31 can be received in the first cavity 171, and the second dust deposition portion 33 can be received in the second cavity 173. The dust deposition plates 311 and the partition 15 can be arranged in parallel.

The air inlet mechanism 40 can include a housing 41 and an air inlet duct 43. The housing 41 can cover the rectifying plate 18. An air inlet cavity 45 can be formed by a connection of the housing 41 and the rectifying plate 18. The air inlet cavity 45 can communicate with the first cavity 171 and the second cavity 173. The air inlet duct 43 can be mounted to the housing 41.

The wind deflector 47 can be received in the air inlet cavity 45. The two elongated blocks 471 can be mounted to opposite sides of the housing 41. The wind barrier 473 can be mounted to the rectifying plate 18 and can extend towards the air inlet duct 43 along a direction of the partition 15. The first wind shield 475 and the second wind shield 477 can be rotationally mounted in the air inlet cavity 45 and can be arranged on either side of the wind barrier 473.

Figure 4:
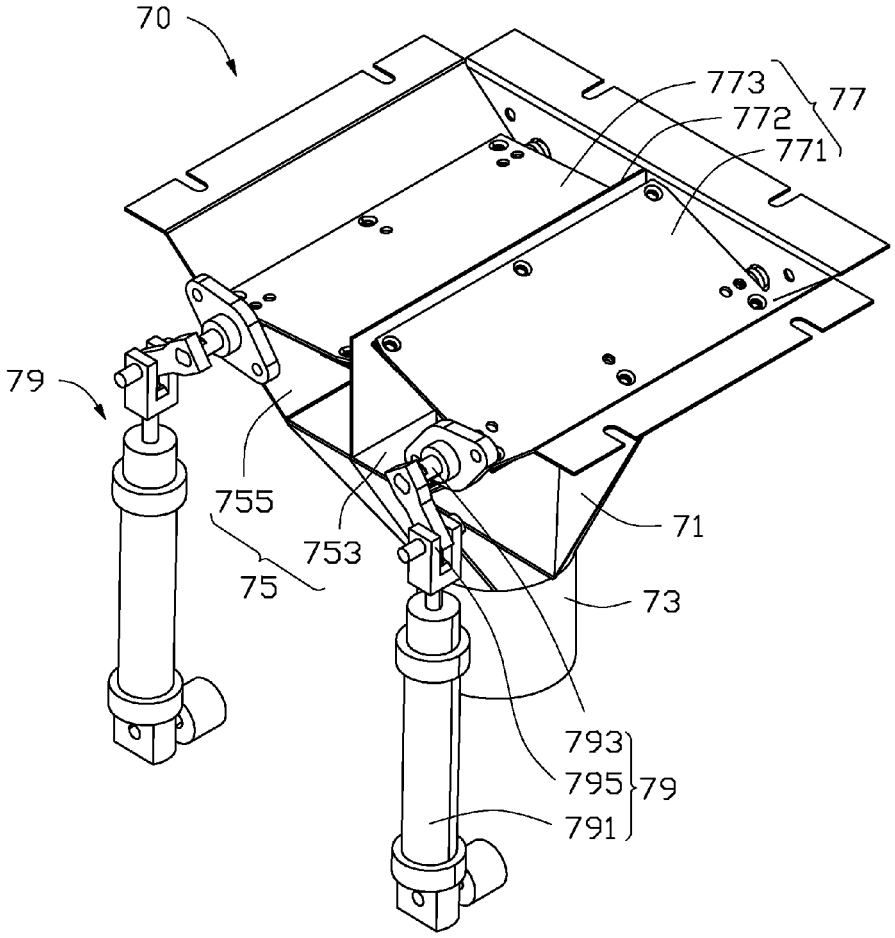
FIG. 4 is a partial, isometric view of a discharge mechanism of the waste collection device as shown in FIG. 1.

FIG. 4 illustrates that the discharge mechanism 70 can further include a stock stop member 77 and two second driving members 79. A discharge cavity 75 can be formed in the discharge housing 71. The discharge cavity 75 can communicate with the first cavity 171 (shown in FIG. 3) and the second cavity 173. The two second driving members 79 can be received in the box 74 (shown in FIG. 2).

The stock stop member 77 can include a first stock stop plate 771, a stock stop partition 772, and a second stock stop plate 773. The stock stop partition 772 can be coupled to the partition 15 (shown in FIG. 3) to divide the discharge cavity 75 into a first discharge cavity 753 and a second discharge cavity 755. The first discharge cavity 753 can communicate with the first cavity 171, and the second discharge cavity 755 can communicate with the second cavity 173. The first stock stop plate 771 can be rotationally mounted above the first discharge cavity 753, and the second stock stop plate 773 can be rotationally mounted above the second discharge cavity 755. When the first stock stop plate 771 closes, one side of the first stock stop plate 771 can resist against the stock stop partition 772 and the other side of the first stock stop plate 771 can resist against the discharge housing 71 to block first discharge cavity 753 and the first cavity 171. The configuration and movement of the second stock stop plate 773 can be the same as those of the first stock stop plate 771.

The structures of the two second driving members 79 can be the same. The two second driving members 79 can be configured to open or close the first discharge cavity 753 and the second discharge cavity 755. Each second driving member 79 can include a second driving rod 791, a second driving shaft 793, and a second linkage 795 coupled to the second driving rod 791 and the second driving shaft 793. In one embodiment, the two second driving members 79 can be cylinders. The second driving shafts 793 can be coupled to the first stock stop plate 771 and the second stock stop plate 773. The second driving rod 791 can drive the second linkage 795, and the second linkage 795 can rotate the second driving shaft 793. The second driving shaft 793 can rotate the first stock stop plate 771 or the second stock stop plate 773. The first discharge cavity 753 or the second discharge cavity 755 can thus be opened or closed.

In operation, the dust-laden air can enter the waste collection device 100 through the air inlet duct 43. The first drive member 49 can move the first rotation shaft 493 to open the first wind shield 475 and close the second wind shield 477. The air can enter the first cavity 171 through the rectifying plate 18. In this situation, the dust deposition plates 311 in the first dust deposition portion 31 can, when powered by a power source such as electricity, become magnetic. The air can pass through the first dust deposition portion 31, and the magnetically-sensitive dust can be adsorbed on the dust deposition plates 311. The air can then be emitted through the air exhaust mechanism 50.

After a period of time, the first drive member 49 can move the first linkage 495 to close the first wind shield 475 and open the second wind shield 477. The air can enter the second cavity 173. In this situation, the magnetism of the dust deposition plates 311 in the first dust deposition portion 31 can be canceled by disconnecting the electric power supply. The second driving member 79 can move the second linkage 795 to open the first stock stop plate 771. The magnetically-sensitive dust can drop into the first discharge cavity 753 and be emitted through the discharge outlet 73. The dust deposition plates 311 in the second dust deposition portion 33 can be electrically powered to become magnetic. The air can pass through the second dust deposition portion 33, and the magnetically-sensitive dust can be adsorbed on the second dust deposition portion 33. The first dust deposition portion 31 and the second dust deposition portion 33 can alternately work to remove the magnetically-sensitive dust from the air.

When the first dust deposition portion 31 or the second dust deposition portion 33 are damaged, the gear 357 can slide the third dust deposition member 353 along a direction of the perforated grating plate 14 to the top of the first dust deposition portion 31 or the top of the second dust deposition portion 33. The third dust deposition member 353 can pass through the perforated grating plate 14 and can enter the cavity 17. The third dust deposition member 353 can replace the first dust deposition portion 31 or replace the second dust deposition portion 33.

The embodiments shown and described above are only examples. Many details are often found in the art such as the other features of a waste collection device 100. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A waste collection device configured to collect magnetically-sensitive dust, and comprising:

a main body having:

a cover;

an electric controller mounted to a side of the cover;

a partition mounted in the cover;

a cavity formed in the cover; and the cavity forming a first cavity and a second cavity, and separated by the partition wherein the first cavity and the second cavity are separated by the partition;

a collection mechanism received in the first cavity and the second cavity and having a plurality of dust deposition portions; wherein each dust deposition portion is electrically connected to the electric controller and has a plurality of dust deposition plates opposite to each other in parallel;

an air inlet mechanism mounted to a side of the main body and having:

a housing;

a first wind shield coupled to the first cavity;

a second wind shield coupled to the second cavity; and a first drive member configured to rotate the first wind shield and the second wind shield to control the opening and closing of the first cavity and the second cavity;

an air exhaust mechanism mounted to another side of the main body opposite the side of the air inlet mechanism; and a discharge mechanism mounted under the main body;

wherein, when the first cavity or the second cavity is opened, the dust deposition plates become magnetic based on a supply of electricity to attract the magnetically-sensitive dust; and wherein, when the first cavity or the second cavity is closed, the electric power supply is removed from the dust deposition plates allowing the magnetically-sensitive dust to drop into the discharge mechanism.

2. The waste collection device as claimed in claim 1, wherein a plurality of evenly distributed dust deposition holes are defined in the dust deposition plates.

3. The waste collection device as claimed in claim 1, wherein the inside of the dust deposition plates comprises an electromagnet.

4. The waste collection device as claimed in claim 1, wherein the collection mechanism further comprises a mounting plate mounted above the main body, the dust deposition plates are vertically arranged to the mounting plate.

5. The waste collection device as claimed in claim 1, wherein:

the air inlet mechanism comprises an air inlet duct, two elongated blocks, and a wind barrier; and the air inlet duct is mounted to the housing, the two elongated blocks are mounted to the two opposite sides of the housing, the wind barrier extends towards the air inlet duct along a direction of the partition.

6. The waste collection device as claimed in claim 5, wherein the first wind shield and the second wind shield are resisted against the wind barrier and the blocks when the first wind shield and the second wind shield close.

7. The waste collection device as claimed in claim 1, wherein:

the first drive member comprises a first drive component, two first rotation shafts, and a first linkage; and the two first rotation shafts are mounted to the ends of the first linkage, and the first wind shield and the second wind shield are respectively mounted to the two first rotation shafts.

8. The waste collection device as claimed in claim 7, wherein the first drive component moves the first linkage, the first linkage rotates the two first rotation shafts, the two first rotation shafts move the first wind shield and the second wind shield to close and open the first cavity and the second cavity.

9. The waste collection device as claimed in claim 1, wherein:

the discharge mechanism comprises a discharge housing, a stock stop partition, a first stock stop plate, a second stock stop plate, and two second driving members;

a discharge cavity is formed in the discharge housing;

the stock stop partition is received in the discharge cavity and coupled to the partition to divide the discharge cavity into a first discharge cavity and a second discharge cavity; and the first discharge cavity communicates with the first cavity, and the second discharge cavity communicates with the second cavity.

10. The waste collection device as claimed in claim 9, wherein:

the first stock stop plate is rotationally mounted above the first discharge cavity, and the second stock stop plate is rotationally mounted above the second discharge cavity; and the two second driving members rotates the first stock stop plate and the second stock stop plate to open and close the first discharge cavity and the second discharge cavity.

11. The waste collection device as claimed in claim 10, wherein:

the second driving member comprises a second driving rod, a second driving shaft, and a second linkage coupled to the second driving rod and the second driving shaft;

the second driving shaft moves the second linkage, and the second linkage rotates the second driving shaft; and the first stock stop plate and the second stock stop plate are respectively mounted to the second driving shaft.

12. The waste collection device as claimed in claim 1, wherein the waste collection device further comprises a replacement mechanism mounted above the main body.

13. The waste collection device as claimed in claim 12, wherein:

the replacement mechanism comprises a housing, a frame, a third dust deposition member, a plurality of grinding teeth, and a gear; and a replacement cavity is formed via mounting the housing outside the frame.

14. The waste collection device as claimed in claim 13, wherein:

the third dust deposition member is received in the replacement cavity, and the grinding teeth and the gear are mounted to a top position of the frame;

the gear is coupled to the third dust deposition member and move the third dust deposition member, and the gear is engaged to the grinding teeth; and the gear slides the third dust deposition member to the top of the collection mechanism, the third dust deposition member enters the cavity to replace the collection mechanism.

15. The waste collection device as claimed in claim 1, wherein a plurality of rectifying plates are arranged to two sides of the cover between the air inlet mechanism and the air exhaust mechanism.

* * * * *